US007191585B2

(12) United States Patent
Vanderbeken et al.

(10) Patent No.: US 7,191,585 B2
(45) Date of Patent: Mar. 20, 2007

(54) ELEVATOR ROPE

(75) Inventors: Bert Vanderbeken, Waregem (BE); Daniël Mauer, Bernissart (BE); René Debue, Deceased late of, Zwevegem (BE); by Rita Hostens, Legal Representative, Zwevegem (BE); Javier Del Rio Rodriguez, Bratislava (SK)

(73) Assignee: NV Bekaert SA, Zwevegem (BE)

( * ) Notice: Subject to any disclaimer, the term of this patent is extended or adjusted under 35 U.S.C. 154(b) by 0 days.

(21) Appl. No.: 10/546,864

(22) PCT Filed: Jan. 29, 2004

(86) PCT No.: PCT/EP2004/050053

§ 371 (c)(1),
(2), (4) Date: Oct. 21, 2005

(87) PCT Pub. No.: WO2004/076327

PCT Pub. Date: Sep. 10, 2004

(65) Prior Publication Data

US 2006/0174604 A1 Aug. 10, 2006

(30) Foreign Application Priority Data

Feb. 27, 2003 (EP) ..... 03100473

(51) Int. Cl.
*D07B 1/06* (2006.01)

(52) U.S. Cl. ..... 57/223; 57/232

(58) Field of Classification Search ..... 57/210, 57/212, 223, 232, 902; 152/451
See application file for complete search history.

(56) References Cited

U.S. PATENT DOCUMENTS

| | | | | |
|---|---|---|---|---|
| 4,532,080 | A * | 7/1985 | Delseth et al. | 556/139 |
| 4,704,334 | A * | 11/1987 | Delseth et al. | 428/458 |
| 4,829,760 | A * | 5/1989 | Dambre | 57/212 |
| 5,342,699 | A * | 8/1994 | DeWitte et al. | 428/625 |
| 5,688,597 | A * | 11/1997 | Kohno | 428/379 |
| 5,836,145 | A * | 11/1998 | Kohno | 57/213 |
| 6,327,842 | B1 * | 12/2001 | Starinshak | 57/212 |
| 6,920,745 | B2 * | 7/2005 | Bruyneel et al. | 57/237 |

FOREIGN PATENT DOCUMENTS

| | | |
|---|---|---|
| EP | 0 444 245 B1 | 9/1991 |
| EP | 0 855 471 B1 | 1/2002 |
| EP | 1 213 250 A1 | 6/2002 |
| EP | 1 273 695 A1 | 1/2003 |

* cited by examiner

*Primary Examiner*—Shaun R. Hurley
(74) *Attorney, Agent, or Firm*—Foley & Lardner LLP

(57) ABSTRACT

An elevator rope comprising an elastomer coated, multi-strand steel wire cable is claimed. In such a cable strands have a lay-length of at least 6.5 times the diameter of the bare cable diameter D. The cable is further coated with an elastomeric jacket, which adheres to the strands with a pull-out force not less than 15×D+15 newton per mm. The advantages of such an elevator rope are amongst others its limited elongation, its reduced diameter and its improved fatigue life.

19 Claims, 2 Drawing Sheets

ELEVATOR ROPE

FIELD OF THE INVENTION

The present invention relates to an elevator rope comprising a core strand, outer strands and an elastomer jacket adhering to at least the outer strands.

BACKGROUND OF THE INVENTION

Two main requirements are posed to an elevator rope: safety and service life. The requirements for elevator ropes are described in European Norm EN 81-1:1998+AC:1999, the more relevant parts being 9.1, 9.2 and 9.3, and annexes M and N.

Safety is ensured by inspection (visual and on regular time intervals), redundancy (at least two ropes carry the cart) and the safety factor (called SF hereafter, i.e. the ratio of breaking load of the rope to the maximum load of cart and freight), which has to be above a certain number (e.g. 12 when 3 ropes are used).

Service life is maximised by the design of the sheave and the rope.

First there is the importance of the metal-to-metal contact on the sheave:

- Hard, higher tensile wires lead to excessive wears of sheave and rope so only lower tensile wires can be used.
- The pressure of the wires on the sheave has to be low enough leading to a requirement of a relatively thick rope.

Second there is the rope design:

- Small lay lengths of the cable strands result in an increased service life.
- Parallel lay is used resulting in line contacts between the wires, such line contacts leading to less cutting between the wires, hence resulting in a longer service life.
- A minimum sheave diameter of 40 times the rope diameter results in low bending stresses in the wire, hence again improving the service life of the rope.
- Impregnating the textile core with lubricant increases the service life.

These requirements have led to elevator ropes as they are known in the art. I.e. wire ropes with a core of a lubricated textile material (e.g. sisal) surrounded by typically 8 strands assembled out of bare or galvanised steel wires having a tensile strength of between 1200 up to 2050 N/mm$^2$. The strands themselves typically contain between 19 and 36 wires and are of parallel lay type as e.g. Warrington, Seale, filler or a combination type e.g. Warrington-Seale. The lay length of the strand in the rope is typically between 5 to 6 times the diameter of the rope. The size of the rope is chosen in function of the total mass of the elevator cart and its load. The diameter range is from 6 to 22 mm, while sizes between 8 to 11 mm are most popular. The international standard ISO 4344 describes these ropes in general.

Although the prior art ropes have fulfilled the requirements for more than a hundred years, they have some inherent drawbacks. First the requirement for a relatively thick rope, in order to reduce rope pressure on the traction sheave, combined with the requirement that the traction and diverting sheave diameters must be at least 40 times the diameter of the rope leads to large sheaves and consequently large machine space requirements. Secondly the relatively small cable lay with respect to the diameter of the rope results in a low modulus or a high elastic elongation leading to a load dependent position of the cart with respect to the floor level. Thirdly the textile core leads to creep which necessitates the regular adjustment of the rope length certainly in the initial stages of the rope usage. A fourth drawback is that the lubricated core regularly needs re-lubrication that can be done manually or by means of an automated lubricant applicator. In either case the cost of the system increases. Also the re-lubrication can considerably change the traction of the rope to the drive pulley, leading to an uncontrolled coefficient of fiction between sheave and rope.

Recent solutions to overcome these problems have been suggested in EP 1 213 250 A1. In this application, an elevator is claimed using an elevator rope having small sized, high tensile wires and an elastomeric coating either inside or outside the rope. While this arrangement will indeed eliminate the first drawback of a relatively large sheave and consequently a large machine space requirement, it does not address the second drawback on the plastic elongation of the rope and the third drawback on the creep phenomenon. In addition, it does not address the problem of how to preserve the integrity of the rope, since it is composed of totally different materials. Hence no indication is given on how to maintain or improve the service life of the rope vis-à-vis the currently used wire ropes which presents a new, fifth drawback

SUMMARY OF THE INVENTION

It is an object of the present invention to eliminate the drawbacks of the prior art. It is also an object of the present invention to provide a rope with a high modulus and a low creep. It is a further object of the invention to eliminate the need for regular relubrication of the rope. It is still a further object of the invention to enhance the service life of the rope. Another object of this invention is the method to produce the elevator rope.

An elevator rope according the present invention comprises a core strand and at least five outer strands twisted around the core strand. These strands comprise a plurality of steel wires that have first been stranded together by at least one stranding and/or bunching operation. The strands are assembled to a rope in a dosing step. The rope assembled in this way has a bare (i.e. uncoated) rope diameter D. The 'bare rope diameter D' can be defined as the diameter of the smallest imaginary circle that circumscribes the transversal cross section of the bare rope. The lay length applied to the outer strands is at least 6.5 times D. Preferably the lay length is less than 12 times D. And most preferably it is between 7 and 10 times D. This bare rope is further provided with an elastomer jacket, which can be rubber or polyurethane. The elastomer adheres to the bare rope with a pull out force expressed in N/mm not smaller than 15×D+15 where D is expressed in mm. More preferred is a value above of 15×D+30 N/mm.

The elevator rope according the present invention has a higher modulus than prior art ropes due to the steel core strand and the longer lay length specification. In this way, the second drawback of prior art ropes is resolved. The steel core strand also does not need relubrication hence eliminating the fourth drawback.

Surprisingly to what is expected in the art the elevator rope according the present invention—with longer lay lengths—still showed a remarkably good resistance in fatigue tests. And as fatigue tests are generally accepted as good indicators for the service life in the technical field of elevator ropes, the present invention thus provides a solution for the fifth drawback. This surprising effect was only obtained when the rope was jacketed into an elastomer having sufficient adhesion to at least the outer strands of the rope, thus forming a composite structure. The adhesion is crucial because all lifting forces exerted by the sheave are transferred to the bare rope by shearing forces occurring between the jacket and the bare rope. A lack of adhesion quickly leads to separation of the jacket from the bare rope leading to premature failure of both jacket and the bare rope as the former is cut by the bare rope and the latter is not longer structurally held by the jacket The minimum level of 15×D+15 N/mm of pull-out force was found to be satisfactory in order to obtain the surprising effect.

While in the prior-art ropes a loss of traction could occur due to excessive lubrication, this is not longer the case for the inventive cord. The polymer jacket ensures a very good traction between sheave and rope. Some safety features (e.g. EN 81.1, section 9.3(c)) require a controlled slip when the cart is at the extremities of its path in order to prevent rope slackening at the one side and rope overloading at the other side of a drive sheave that does not stop. This can be conveniently implemented by either selection and/or adjusting the polymer composition or by adjusting the coating of the sheave e.g. with a friction reducing layer.

As the elevator rope according the invention does not have a textile core, the creep—which is due to slow squeezing of the textile core during use, resulting in a lower rope diameter and hence elongating outer strands—is eliminated as a steel core strand is non-compressible. In this way the third drawback is eliminated.

The invention will now be described in more detail.

The steel used for the steel wires of the invention preferably has a plain carbon steel composition. Such a steel generally comprises a minimum carbon content of 0.40 wt % C or at least 0.70 wt % C but most preferably at least 0.80 wt % C with a maximum of 1.1 wt % C, a manganese content ranging from 0.10 to 0.90 wt % Mn, the sulfur and phosphorous contents are each preferably kept below 0.03 wt %; additional micro-alloying elements such as chromium (up to 0.2 to 0.4 wt %), boron, cobalt, nickel, vanadium—a non-exhaustive enumeration—may also be added.

The steel wires used can be without any coating. Or the wires can be coated electrolytically with brass having a composition of between 62.5 and 75 wt % Cu, the remainder being zinc. The total coating mass is between 0 to 10 g/kg. Or the wires can be coated with zinc with a coating mass ranging from 0 to 100 g of zinc per kg of wire. The zinc can be applied onto the wire by means of an electrolytic process or by means of a hot dip process, followed or not followed by a wiping operation in order to reduce the total weight of the zinc. Because of the corrosion protection of zinc and the presence of an iron zinc alloy layer that forms during the hot dip operation, the latter coating type is preferred. Other coating types such as ternary coatings or coating applied through a plasma process are equally well included in the invention. It should be clear that the enumeration of coating types is non-exhaustive. Let it also be dear that the coating type can differ between strands.

The steel wires which are formed into an outer strand have a tensile strength of more than 2650 N/mm$^2$, or more preferably above 3000 N/mm$^2$, or even more preferably above 4000 N/mm$^2$ the latter being the highest minimum tensile strength now achievable in the art. The higher the tensile strength, the smaller the wire can be for the same breaking load, the smaller the strand can be, the smaller the elevator rope can be, the smaller the sheaves can be thus reducing the space requirements for the driving machinery. In this way the first drawback of the prior art is eliminated.

It is also an advantageous side effect of the invention that with longer lay lengths, better use is made of the strength of the strands since the strands are better aligned in the direction of the traction force. So to attain the same breaking load level of the elevator rope, the breaking load of the outer strands can be reduced when using a longer rope lay length, hence the outer strands and thus the overall rope can be made thinner again counteracting the first drawback of the prior art.

Due to the reduced metal surface $A_{metal}$ by using higher tensile wires, an increase in elongation ΔL between minimum and maximum load on the rope of length L can be expected. Indeed, the modulus E of the rope does not change with the increased tensile strength of the wires, but the metal surface area does decrease which leads to a higher elongation ΔL according the known formula:

$$\Delta L = \frac{L \cdot \Delta F}{E \cdot A_{metal}}$$

in which ΔF represents the difference between maximum and minimum load. It is again an advantageous side effect of the invention that the longer lay lengths compensate for this because they result in a higher E-modulus.

Preferably the outer strands have an opposite lay direction to the lay direction of the rope.

The tensile level of the steel wires of the central strand is non-delimited, but more preferred is that they have a lower than 2650 N/mm$^2$ tensile strength. Even more preferred is that they have a tensile strength lower than 2400 N/mm$^2$, and even more preferred is that they have a tensile strength below 2100 N/mm$^2$. Although the lower tensile strength of the core leads to a lower breaking load of the rope, it has the advantage that it improves the resistance to fatigue.

Different types of outer strands can be formed comprising 6 or more wires. More preferred is that they contain 7 wires, even more preferred is 19 wires and more. They can be assembled according any arrangement known in the art, e.g. according cross lay, according Warrington parallel lay, according Seale parallel lay, or any combination of parallel lay. The parallel lay is preferred above the cross lay. It will be dear to the person skilled in the art that in order to achieve these configurations, different wire diameters have to be used.

The rope must contain at least 5 outer strands, more preferred are 6 outer strands and most preferred is 8 outer strands, although 9 outer strands are also possible.

The core strand is preferably but not necessarily of the same arrangement of the outer strands. The diameter of the core strand, and hence the diameters of the wires in the core strand, is chosen in such a way that at least the outer strands do not touch one another. More preferable is that the gap between the outer strands is at least 0.010 times D even more preferable is that the gap is larger than 0.020 times D, and even more preferable is a gap larger than 0.025 times D. The gap is to be considered in the direction perpendicular to the strand. Note that the gap increases with longer lay lengths. The larger lay lengths according the invention are thus favorable to increase the gaps.

The gap is necessary in order to allow the flow of elastomer in between the strands. In this way the voids between the strands can be filled to a certain 'filling degree'. The 'filling degree' can be defined as follows:

when taking a cross section of the bare rope perpendicular to the rope, a certain area within the outer circumscribed circle (with diameter D) will not be occupied by steel and will be void. Let us call this area '$A_{void}$'.

when taking a cross section of the coated rope perpendicular to the rope, a certain area of the voids within the circumscribed circle will now be occupied by an elastomer. An area we call '$A_{elastomer}$'.

The filling degree can now conveniently be expressed as the ratio of $A_{elastomer}$ to $A_{void}$ in percent. According the invention, a filling degree of 15% is needed, although a filling degree above 30% is more desirable. As a secondary effect, a good filling degree will also contribute to fix the outer strands in the elevator rope, thus increasing the modulus of the elevator rope which is helpful to counteract the second drawback of the prior art.

The elastomer used for the jacket comprises any elastomeric material that can conveniently be applied to the rope with sufficient adhesion. As an elastomer rubber can be used. The particular environment in which the elevator rope is used dictates the choice of compound. The rubber compound can be a suitable polychloroprene rubber having a fire resistance. The rubber compound can also be a nitrile rubber when the elevator rope is used in low temperature environments or environments with oil, or it can be an EPDM rubber i.e. an ethylene-propylene diene modified terpolymer, for an adequate weakening resistance and a low friction.

More preferably a thermoplastic elastomer (TPE) can be used. Non-delimiting examples are polystyrene/elastomer block copolymers, polyurethane (PU) or polyurethane copolymers, polyamide/elastomer block copolymers, thermoplastic vulcanizates. Preferably thermoplastic polyurethane is used. Homopolymers of ester, ether or carbonate polyurethane may be used, as well as copolymers or polymer blends. Preferably, the polymer material has a shore hardness varying between 30A and 90D. Also preferred is to use a clear thermoplastic elastomer. This still allows for a visual inspection of the metallic rope for possible rope damage.

The thickness of the jacket is non-delimited. As thickness of the jacket at a certain point is understood the shortest distance in a plane perpendicular to the cable direction between the point at the surface of the jacket and the closest metallic point Preferably it is between 0.0 to 2.0 mm at every outer point of the jacket. The coating can follow the outer shape of the bare cable, or it can have a slightly rounder shape. The overall outer shape of the jacket is not important for the invention i.e. it is not necessary that the outer circumference of the jacket is near to round.

The method to produce the elevator rope will now be described in detail.

The production of the wires and the strands is performed according known prior art techniques of wet wire drawing followed by cabling or bunching.

During dosing of the rope, particular care must be taken in order to have a preforming ratio below 102%. More preferably is to have a preforming ratio between 95 and 100%. Most preferred is preforming ratio between 96 and 98%. The preforming ratio of the peripheral strands can be measured as follows. A predetermined length (e.g. 500 mm) of an assembled rope is taken and measured exactly. Next the peripheral strands are disentangled from the bare rope without plastically deforming the strands. The preforming ratio (called PR hereafter) is determined as:

$$\text{Preforming ratio } (\%) = \frac{\text{length of bare elevator rope}}{\text{length of disentangled strand}} \times 100$$

It is an object of the invention that the PR must be within these limits in order to obtain a rope that is processable in the following steps, notably the step where jacketing is applied to the rope.

After an optional cleaning operation, the rope is then coated with a primer selected from organo functional silanes, organo functional titanates and organo functional zirconates which are known in the art for said purpose. Preferably, but not exclusively, the organo functional silane primers are selected from the compounds of the following formula:

$$Y—(CH_2)_n—SiX_3$$

wherein:

Y represents an organo functional group selected from —$NH_2$, $CH_2$=CH—, CH=C($CH_3$)COO—, 2,3-epoxypropoxy, HS— and, Cl—

X represents a silicon functional group selected from —OR, —OC(=O)R', —Cl wherein R and R' are independently selected from $C_1$ to $C_4$ alkyl, preferably —$CH_3$, and —$C_2H_5$; and n is an integer between 0 and 10, preferably from 0 to 10 and most preferably from 0 to 3

The organo functional silanes described above are commercially available products.

The primer can be applied onto the rope by dipping or painting or any other technique known in the art. Preferably dipping is used, followed by a drying operation.

The following stop is the coating of the rope with the jacket material. This can be done by means of injection moulding, powder coating, extrusion, or any other means as known in the art. Preferably extrusion is used. Here the preforming ratio plays a significant role in the proccessability of the rope: if the PR is too high, this will result into "sleeving" of the rope during extrusion. Sleeving of the rope is the phenomenon that occurs when the slack of the outer strands is accumulated by the movement of the rope through a tightly fitting aperture. The outer strands tend to unwind leading to the formation of an opening rope, just in front of the aperture. This sleeving leads to crossed outer strands which renders the subsequent rope unusable and which also leads to interruptions of the rope due to fracture of the outer strand or even the complete rope.

BRIEF DESCRIPTION OF THE DRAWINGS

The invention will now be described into more detail with reference to the accompanying drawings wherein.

DESCRIPTION OF THE PREFERRED EMBODIMENTS OF THE INVENTION

Figure 1:
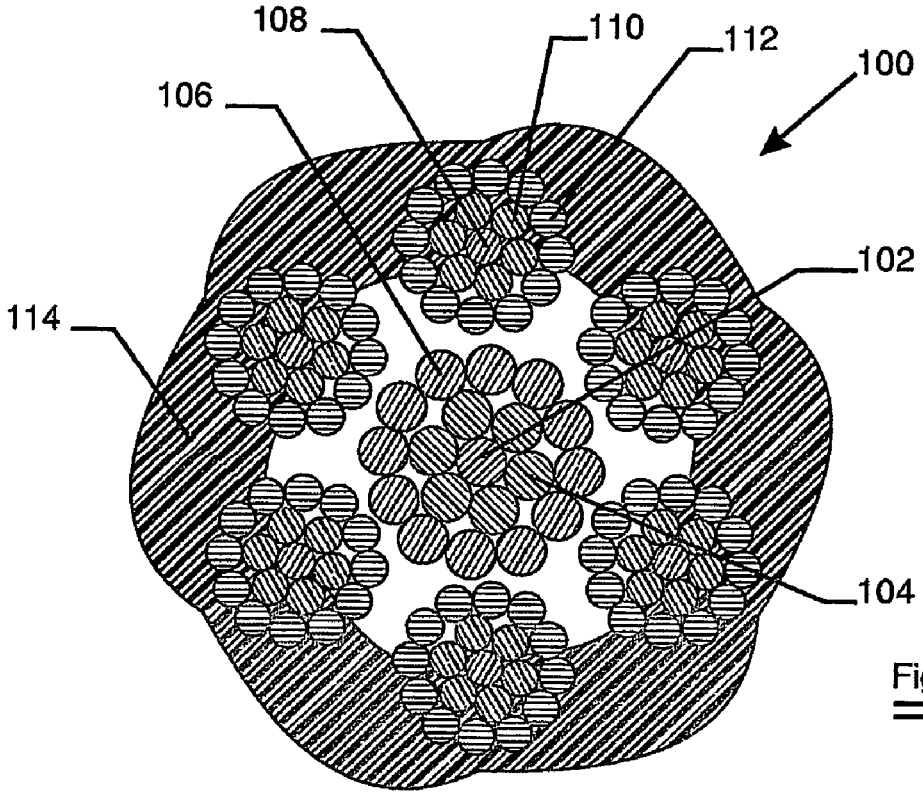
FIG. 1: shows a cross section of a first embodiment of the elevator rope

In a first preferred embodiment, depicted in FIG. 1, a 7×19 rope was produced of the following rope formula:

$$\{[(0.44+6\times0.37)_{7z}+12\times0.34]_{14z}+6\times[(0.34+6\times0.31)_{10s}+12\times0.29]_{20s}\}_{LL\ Z}$$

which is a regular cross lay rope. The diameter of this bare rope is 4.95 mm. The lay of the rope LL was varied over a range of 34 to 46 mm. The filaments had the following tensile strength (table 1):

TABLE 1

| Nominal diameter (mm) | Tensile strength ($N/mm^2$) | Reference Nr. FIG. 1. |
|---|---|---|
| | Core strand filaments | |
| 0.44 | 2325 | 102 |
| 0.37 | 2557 | 104 |
| 0.34 | 2603 | 106 |
| | Outer strand filaments | |
| 0.34 | 2671 | 108 |
| 0.31 | 2655 | 110 |
| 0.29 | 2690 | 112 |

The filaments were zinc coated.

The following results (table 2) were obtained on the bare ropes:

TABLE 2

| Laylength LL (in mm) | Laylength in × D | Breaking Load (N) | Modulus ($N/mm^2$) | Air gap (in × D) |
|---|---|---|---|---|
| 34 | 6.9 × D | 22 482 | 102 730 | 0.020 × D |
| 38 | 7.7 × D | 22 839 | 111 748 | 0.023 × D |
| 42 | 8.5 × D | 22 870 | 125 213 | 0.026 × D |
| 46 | 9.3 × D | 23 282 | 132 418 | 0.028 × D |

The results confirm the trends as known in the state of the art i.e. a higher breaking load and a higher modulus with increasing lay.

The rope with 34 mm laylength was chosen for further processing. It had a performing ratio of 97.2%. The breaking load in bare condition was 21.4 kN.

First the rope was cleaned by means of a steam-degreasing step.

Subsequently the rope was led through a dipping tank containing a solution of 1.5 vol. % of N-(2-amino ethyl)-3-amino propyl tri methoxy silane dissolved in a mixture of isopropanol and water. Air-drying followed the dipping.

As a next step the rope was coated in an extrusion line with clear polyurethane Desmopan® of Bayer. The speed and the pressure were adjusted in order to obtain an optimised filling degree of the PU (FIG. 1, 114) into the rope. Out of the cross section of FIG. 1, an elastomer filling degree can be estimated of 20 to 30% between the strands. After jacketing, the rope had a breaking load of 21.7 kN.

Figure 2:
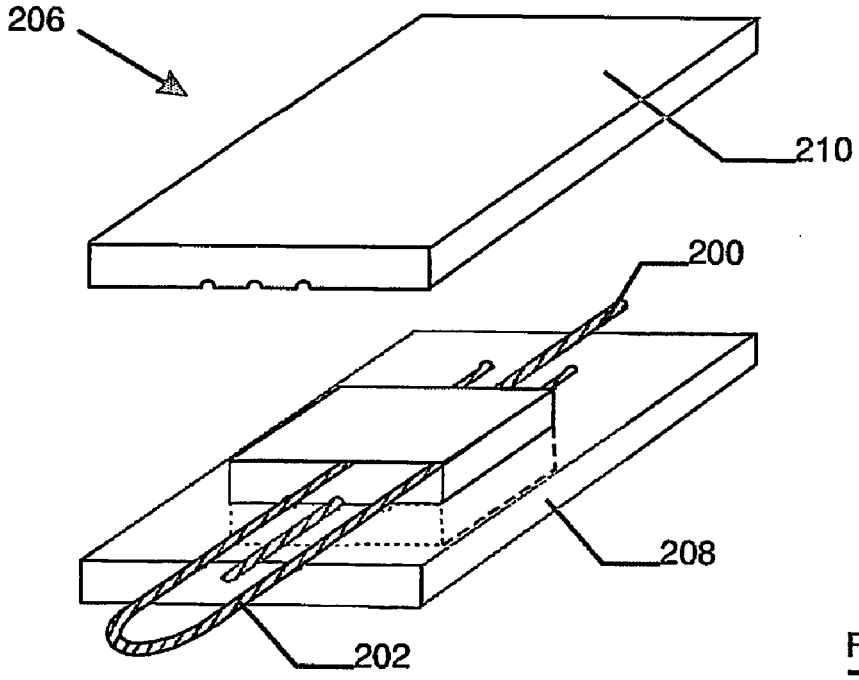
FIG. 2: shows a drawing of the testbody for adhesion testing

During each stage of the processing, samples were taken and an adhesion test was performed. The adhesion testing form is illustrated in FIG. 2. Two ropes (200 and 202) are positioned in a mold 206 with inner dimensions 50 mm×50 mm×12.5 mm. The mold is built-up out of two halves, 208 and 210. The rope to be tested 200 is positioned in the center, while a single rope, led into a loop 202 fills the outer positions. Once the ropes are positioned, the mold halves 208 and 210 are dosed and filled with the same PU as used for the jacket. After a 24-hour rest period, the mold is opened. The center rope 200 is clamped in the top damp of a tensile tester, while the lower damp holds the rope loop 202. The center rope is pulled out at a speed of about 50 mm/min and the maximum force is recorded. This is the pull out force that is divided by 50 mm—the embedment length of the rope—in order to obtain the pull-out force per mm. The results of the test (in N/mm) are reproduced in table 3 below.

TABLE 3

| Repeats | Sample #1 | Sample #2 | Sample #3 |
|---|---|---|---|
| 1 | 59.1 | 170.5 | 199.0 |
| 2 | 70.1 | 167.0 | 203.6 |
| 3 | | 177.0 | 171.2 |
| Average | 64.6 | 171.5 | 191.3 |

Sample #1 was the bare rope with only the zinc coating. Sample #2 was the rope after application of the functional organo silane, Sample #3 was the rope coated with the PU outer jacket According the invention, the pull-put force must be at least 90 N/mm.

Figure 3:
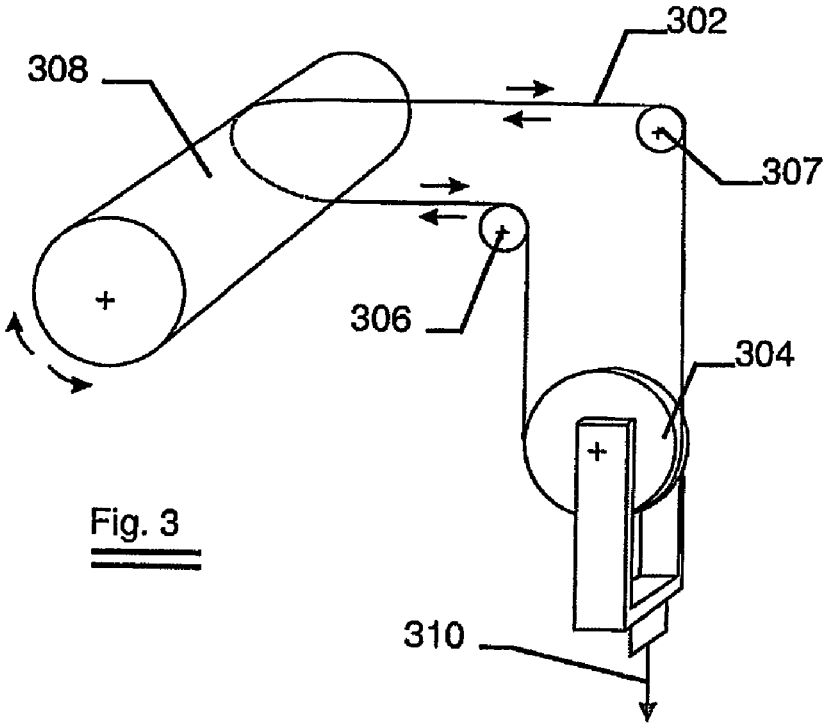
FIG. 3: shows a drawing of the fatigue test used.

Next the rope was subjected to a fatigue test simulating the use of the rope in an actual elevator. The test is illustrated in FIG. 3. The rope under test 302 driven by an oscillating drum 308 is cyclically bent over the testing pulleys 306 and 307. The rope is further led over a reversing pulley 304 on which a force 310 is exerted. The following test conditions apply:

Diameter of the testing pulleys 406 and 407: 200 mm (i.e. 40×D)

Rope length under test 350 mm

Tension applied: 1800 N or 182 $N/mm^2$

Frequency of oscillation: one complete cycle in 1 sec.

The following results were obtained:

TABLE 4

| | |
|---|---|
| Bare rope | $257.10^3$ cycles, full fracture |
| Coated rope | $8.10^6$ cycles, no fracture |

After being led off, the tested coated rope still showed a breaking load of 20.7 kN or 95% of the original breaking load.

Figure 4:
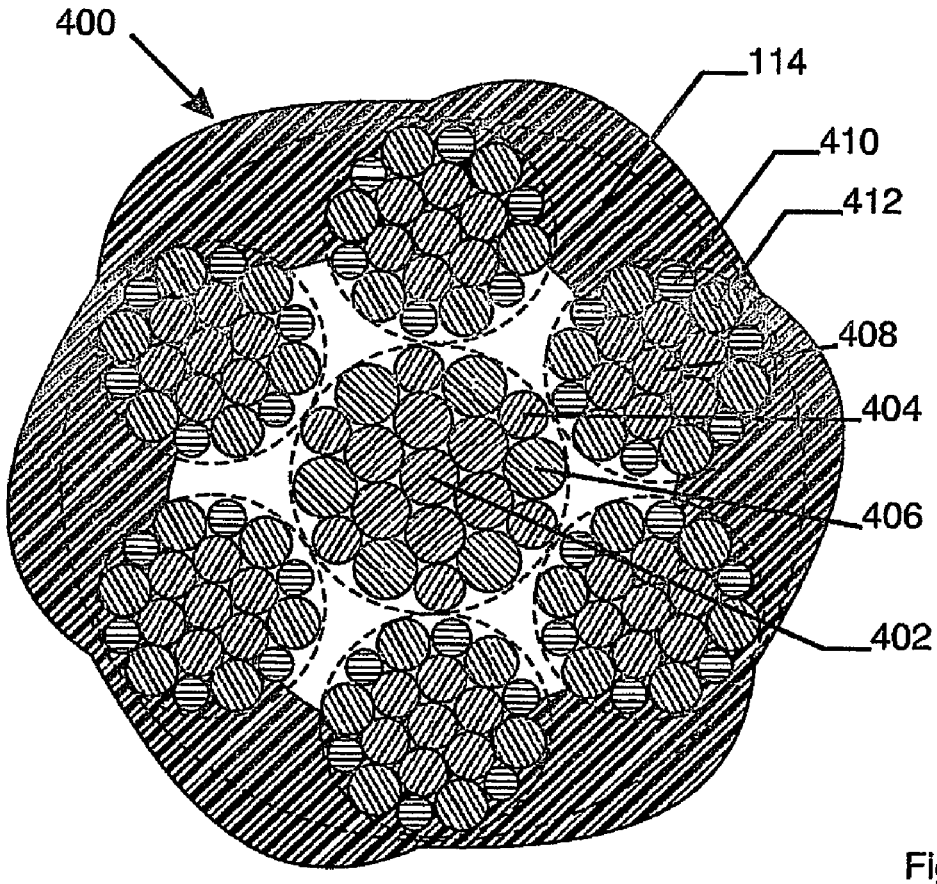
FIG. 4: shows a cross section of a second embodiment of the elevator rope

A second preferred embodiment is a rope where the strands are of Warrington type arrangement. There the filaments are arranged as depicted in FIG. 4. The rope 7×19W 400, has the following formula:

$$[(0.41+6\times0.41|6\times0.34|6\times0.44)_{20z}+6\times(0.34+6\times0.34|6\times0.28|6\times0.37)_{24s}]_{40Z}$$

The diameter is 5.0 mm, yielding a lay length of 8×D for the outer strands. The wires are zinc coated. The tensile strength levels are as in the following table 5:

TABLE 5

| Nominal diameter (mm) | Tensile strength ($N/mm^2$) | Reference Nr. FIG. 4. |
|---|---|---|
| | Core strand filaments | |
| 0.41 | 2339 | 402 |
| 0.34 | 2618 | 404 |
| 0.44 | 2234 | 406 |
| | Outer strand filaments | |
| 0.34 | 3172 | 408 |
| 0.28 | 3435 | 410 |
| 0.37 | 3057 | 412 |

The rope has a nominal breaking load of 30 kN. The gaps between the strands are 123 μm, corresponding to 0.024×D. Again the cord was treated according the process of the first embodiment (cleaning, dipping in the same organo functional silane followed by an extrusion with the same dear Desmopan® from Bayer). Repeated adhesion tests gave the following results:

TABLE 6

| Cord preparation | Result |
|---|---|
| Bare cord | from 35.6 to 75.9 N/mm |
| Cord coated with PU outer jacket | from 178 to 289 N/mm |

Again the treatment with a functional organo silane yields about 5 times better adhesion pull-out forces. According claim 1 of the invention, the pull-out force must be above 90 N/mm, according claim 2 preferably above 105 N/mm.

Again the rope was subjected to a fatigue test simulating the use of the rope in an actual elevator, as was the first embodiment The following test conditions apply:

Diameter of the testing pulleys 406 and 407: 200 mm (i.e. 40×D)

Rope length under test 350 mm

Tension applied: 2500 N or 203 N/mm$^2$

Frequency of oscillation: one complete cycle in 1 sec.

Note that the axial stress applied is about 12% higher than in the tests for the first embodiment.

The sample according the second embodiment ran for $8 \cdot 10^6$ cycles in the fatigue test without fracture. The breaking load barely changed after the test as showed in Table 7:

TABLE 7

| Before the fatigue test | After the fatigue test |
|---|---|
| 29641 kN | 29319 kN |
| 29956 kN | 30337 kN |

The invention claimed is:

1. An elevator rope having a bare rope diameter D, said elevator rope comprising a core strand and at least five outer strands twisted around said core strand, said core strand and said outer strands comprising a plurality of steel wires, said elevator rope further comprising a jacket, said jacket comprising an elastomer, said jacket surrounding and penetrating between said outer strands characterised in that said jacket adheres to at least said outer strands with a pull-out force expressed in N/mm not less than 15×D+15 where D is expressed in mm and in that;

the lay length of said outer strands around said core strand is larger than 6.5 times D.

2. An elevator rope as in claim 1, wherein said jacket adheres to at least said outer strands with a pull-out force of not less than 15×D+30.

3. An elevator rope as in claim 1, wherein the lay length of said outer strands around said core strand is smaller than 12 times D.

4. An elevator rope as in claim 1, wherein the lay length of said outer strands around said core strand is between 7 and 10 times D.

5. An elevator rope as in claim 1, wherein said outer strands comprises filaments with a tensile strength of at least 2650 N/mm$^2$.

6. An elevator rope as in claim 5, wherein said core strand comprises filaments with a tensile strength of at most 2650 N/mm$^2$.

7. An elevator rope as in claim 5, wherein said core strand comprises filaments with a tensile strength of at most 2500 N/mm$^2$.

8. An elevator rope as in claim 1, wherein said rope has an elastomer filling degree of at least 15% between said outer strands.

9. An elevator rope as in claim 1, wherein said rope has an elastomer filling degree of at least 30% between said outer strands.

10. An elevator rope as in claim 1, wherein said elastomer is a thermoplastic elastomer.

11. An elevator rope as in claim 1, wherein said elastomer is a polyurethane.

12. An elevator rope as in claim 1, wherein said elastomer is a rubber.

13. A method to produce an elevator rope having a bare rope diameter D and the product resulting from said method, said method characterized by the following steps:

A. Assembling the outer strands around the core strand with a lay length that is larger than 6.5 times D.

B. Coating the rope with a primer in order to obtain a pull-out force expressed in N/mm of at least 15×D+15 where D is expressed in mm.

C. Applying the outer jacket around the rope.

14. A method according to claim 13 wherein said outer strands have a preforming ratio between 95 and 100%.

15. A method according to claim 13 wherein the preforming ratio is between 96 and 98%.

16. A method according to claim 13, wherein the primer is an organo functional silane.

17. A method according to claim 13, wherein the primer is an organo functional titanate.

18. A method according to claim 13, wherein the primer is an organo functional zirconate.

19. A method according to claim 13, wherein the elastomer is applied by means of an extrusion.

* * * * *